United States Patent [19]

Johnson, deceased

[11] Patent Number: 4,509,941

[45] Date of Patent: Apr. 9, 1985

[54] FRACTIONATION DEVICE AND METHOD

[75] Inventor: Leighton C. Johnson, deceased, late of Edwardsburg, Mich., by Ann Johnson, Administratrix

[73] Assignee: Miles Laboratories, Inc., Elkhart, Ind.

[21] Appl. No.: 551,109

[22] Filed: Nov. 14, 1983

[51] Int. Cl.[3] ..... B04B 7/16

[52] U.S. Cl. ..... 494/45

[58] Field of Search ..... 494/45, 60, 64

[56] References Cited

U.S. PATENT DOCUMENTS

| | | | |
|---|---|---|---|
| 2,585,753 | 2/1952 | Drury | 494/45 |
| 3,096,283 | 7/1963 | Hein | 494/45 |
| 3,982,691 | 9/1976 | Schultz | 494/45 |

FOREIGN PATENT DOCUMENTS

| | | | |
|---|---|---|---|
| 2325694 | 12/1974 | Fed. Rep. of Germany | 494/45 |

*Primary Examiner*—Robert W. Jenkins
*Assistant Examiner*—Arthur D. Dahlberg
*Attorney, Agent, or Firm*—Roger N. Coe

[57] ABSTRACT

Centrifuge device and method for fractionation and separation of finely divided solid particulate material suspended in a liquid are disclosed. The centrifuge device comprises an enclosure means for enclosing suspending liquid, a liner for entrapping solid particles present in the suspending liquid, a cap for retaining the liquid and liner in said enclosure means and rotation means for rotating the enclosure means about the vertical axis thereof.

6 Claims, 4 Drawing Figures

FRACTIONATION DEVICE AND METHOD

FIELD OF THE INVENTION

The present invention relates to a centrifuge device and a method for the fractionation and separation of finely divided solid particulate materials suspended in a liquid. The device and method have special applicability for fractionating and separating biological particulate material from suspending liquid, and especially the fractionation and separation of solid blood components from a suspending liquid, e.g., plasma, salinic solutions and the like. An important embodiment is the fractionation and separation of cellular components from whole blood.

BACKGROUND OF THE INVENTION

Centrifuge devices and methods designed to separate finely divided particulate material from suspending liquid are well known in the art. Such devices and methods have been utilized for the separation of solid blood components from whole blood or from a liquid blood fraction. While the present invention has broader utility than the separation of blood components, for the sake of conciseness the invention will be principally described in terms of the embodiment of separation of solid blood components.

Until relatively recently, blood tranfusions were always given using whole blood. There is, however, growing acceptance within the medical profession for transfusing only those blood components required by a particular patient instead of transfusing whole blood. Transfusing only those blood components necessary preserves the available supply of blood and, in many cases, it is better for the patient. Before blood component transfusions can be widely employed, however, satisfactory blood separation techniques and apparatus must evolve.

One technique which is widely used is plasmapheresis, viz., the separation of whole blood into a plasma rich component and a plasma poor component. Typically, plasmapheresis is employed on a large scale using satellite pouch systems, as described in U.S. Pat. Nos. 3,190,546; 3,211,368 and 3,545,671. Typically, the plasma rich component is retained for later use and the plasma poor component is returned to the donor. Thus, with such systems whole blood is withdrawn from a donor and flows to a pouch containing an anticoagulant. The pouch is then disconnected from the donor phlebotomy line, centrifuged in a swinging bucket type centrifuge in which cells must travel about half the long dimension of the pouch, typically about 12 centimeters. The centrifuge must then be gently slowed to a stop and the pouch carefully lifted from the bucket of the centrifuge while avoiding remixing of the two components. The pouch is mounted in a plasma expressor and supernatant plasma fraction is expressed into a connected plasma pouch, care being given to clamp off the connecting tube between the pouches just before the plasma poor component passes over. The pouch containing the plasma poor component is then reconnected to the phlebotomy line so that the plasma poor component can be returned to the donor.

It often takes approximately 1.5 hours using satellite pouch techniques to obtain 500 milliliters (ml) of separated plasma rich component and to return the plasma poor component to the donor, even though the time for donating a unit of whole blood is only about 20 minutes.

This relatively long processing time poses a major limitation on volunteer donor recruitment. Moreover, because the blood pouch is disconnected from the donor at the end of each withdraw cycle and transported to and from a separate centrifuge room for centrifugation there is always a danger of returning blood components to a donor which are not his or her own. As previously mentioned, satellite pouch systems also require careful handling of the separated plasma rich and plasma poor components to avoid remixing, thereby ruining the separation.

In general, devices designed for fractionation and separation of cellular components from whole blood tend to be mechanically complicated, expensive, ineffective and difficult to clean or sterilize for use. For example, U.S. Pat. Nos. 3,096,283; 3,244,362 and 3,297,244 describe a variety of rather mechanically complicated, expensive containers for separating cellular components from whole blood. U.S. Pat. Nos. 4,007,871; 4,010,894; 4,094,461; 4,120,448; and 4,386,730 are directed to centrifuge systems for effecting separation of various fractions of cellular blood components through complicated series of tubing, channels, etc. such that the various separated blood components can be drawn off and recovered.

As can be appreciated, none of the prior art devices provides a totally satisfactory method for removing substantially all cellular components from whole blood inexpensively, quickly, conveniently and in a sterile manner.

SUMMARY OF THE INVENTION

An object of the present invention is to provide a centrifuge device and method for fractionating, and separating finely divided solid particulate material suspended in a liquid.

Another object of the present invention is to provide a system for the fractionation and separation of cellular components from whole blood.

Still another object of the present invention is to provide a mechanically simple, inexpensive, reliable centrifuge device and method for fractionating and separating finely divided solid particulate material suspended in a liquid.

A further object of the present invention is to provide a disposable centrifuge device for fractionating and separating finely divided solid particulate material suspended in a liquid.

In accordance with the present invention, a portion of an enclosure means is lined along the surface of an interior wall with an absorbent material. An aliquot of sample, i.e., blood, is placed in the enclosure means through a suitable opening and the enclosure means is then rotated at high speed forcing the sample to flow as a parallel layer along the surface of the absorbent material causing particulate components present in the sample to become enmeshed or trapped in the absorbent material thereby separating the particulate components from the liquid component. The liquid component can then be recovered.

BRIEF DESCRIPTION OF THE DRAWINGS

Other and further objects, advantages and features of the invention will be apparent to those skilled in the art from the following detailed description thereof taken in conjunction with the accompanying drawings in which.

DESCRIPTION OF THE PREFERRED EMBODIMENT

The apparatus forming the subject matter of the present invention is characterized by enclosure means, i.e., a cup or container, lined along a portion of an interior wall with an absorbent material and having a cap or cover for retaining the absorbent material inside the enclosure means. The cover can have an opening for introduction of liquid material. The resulting centrifuge device is designed to fit in a cup holder which is supported by the shaft of a high-speed motor for rotating the cup thereby causing fractionation and separation of finely divided solid particulate material suspended in the liquid material introduced into the device.

Figure 1:
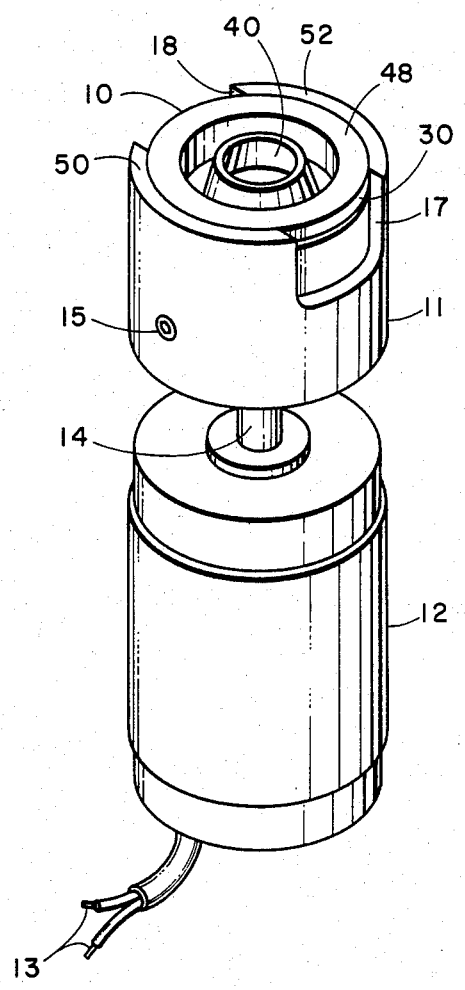
FIG. 1 is a perspective view of the centrifuge device of the present invention supported on a shaft of a high-speed motor.

Turning now to FIG. 1 of the drawings, centrifuge device 10 of the present invention is shown inserted in a holder 11 which can be permanently attached to a high-speed motor 12. Motor 12 is connected by means of lines 13 to a suitable power source (not shown) and is designed to rotate holder 11 and hence centrifuge device 10 thereby bringing about the fractionation and separation of finely divided solid particulate material suspended in liquid inside centrifuge device 10. Holder 11 is attached to shaft 14 of motor 12 by suitable means such as set screw 15. Preferably, holder 11 is designed to conform closely to the outer configuration of centrifuge device 10 such that device 10 and holder 11 are held together by friction fit which causes centrifuge device 10 to rotate when holder 11 rotates. For convenience, holder 11 is designed with U-shaped cutaway surfaces 17 and 18 on opposite sides in order to facilitate the insertion and removal of centrifuge device 10 into and from holder 11 by means of a thumb and forefinger of one's hand.

Figure 2:
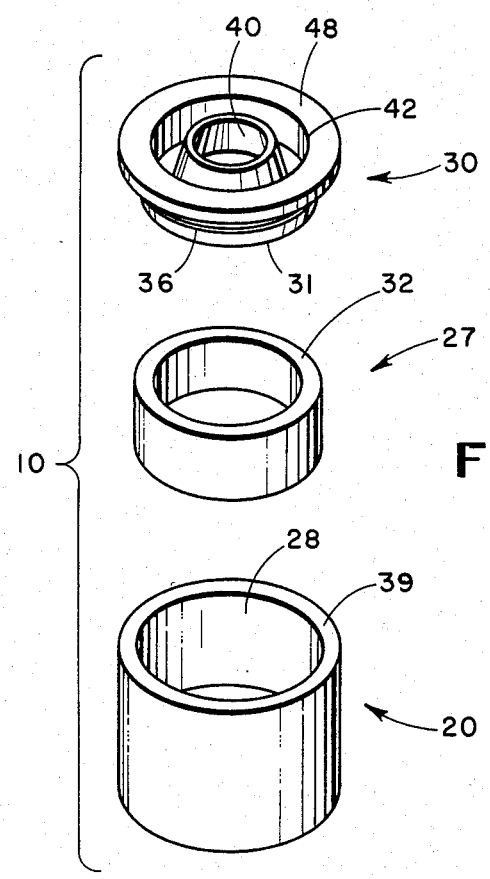
FIG. 2 is an exploded view of the centrifuge, device of FIG. 1, illustrating the components thereof.
Figure 3:
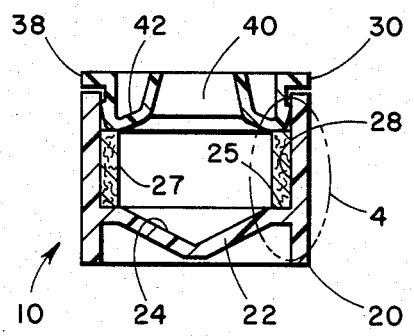
FIG. 3 is a side view, in cross section, of the centrifuge device of the present invention in its assembled form.

The construction of centrifuge device 10 is best seen in FIGS. 2 and 3. Centrifuge device 10 consists of a cylindrical cup or container 20 with a conical base 22 for retention of liquid material in the cavity formed by sloping wall 24. A portion of the cylindrical wall 28 above ledge 25 is lined with cylindrical liner 27. A removable cap or cover 30 completes the assembly of centrifuge device 10. The lower edge 31 of cap 30 rests on upper surface 32 of insert 27 while side portion 36 of cap 30 engages side wall 28 of cup 20 and a lip 38 on cap 30 rests on end 39 of cup 20. Cap 30 can have a restricted opening 40 for the introduction of liquid into cup 20. Opening 40 is preferably, but not necessarily, surrounded by a recess 42 for retaining any liquid which is spilled during the fractionation and separation operations.

Centrifuge device 10 is assembled by inserting liner 27 inside cup 20 and then pressing cap 30 down over the open end of cup 20. Centrifuge device 10 can then be inserted into holder 11 such that top surface 48 of cap 30 remains substantially flush with top edges 50 and 52 of holder 11 (FIG. 1).

Figure 4:
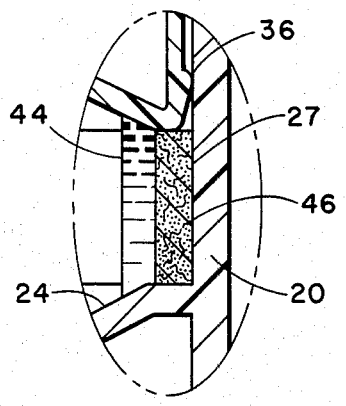
FIG. 4 is a partial side view, in cross section, of the centrifuge device of the present invention taken along ellipsoidal line 4 in FIG. 3.

Liquid sample can be introduced through opening 40 by suitable means to fill or to partially fill conical base 22 formed by sloping wall 24 of cup 20. As the liquid sample, containing finely divided solid particulate material, is rotated inside holder 11 by means of shaft 14 of motor 12 centrifugal force causes a liquid layer 44 (FIG. 4) to form adjacent insert 27. In addition, the centrifugal force caused by the rotation of cup 20 about its vertical axis causes the separation of solid particulate material from the liquid layer 44. Thus, red blood cells, in the case of whole blood, gravitate (or elutriate) in the direction of the centrifugal force, i.e., toward the outer extremity 46 of insert 27 and cellular material becomes entrapped in the voids of insert 27. Upon the completion of the centrifugal operation, liquid returns to the lowest point of cup 20, namely conical cavity 22 formed by wall 24, and the cellular material remains enmeshed or trapped in the voids of insert 27. Liquid, free of such cellular material, can be withdrawn from centrifuge device 10 by any suitable means, such as a syringe.

Because of the simplicity of the construction and the nature of the materials involved, the components of centrifuge device 10 can be made to be disposable after each use. Alternatively, the design of centrifuge device 10 permits insert 27 to be discarded after each use while cup 20 and/or cap 30 are cleaned for reuse.

Prior to discarding insert 27, entrapped particulate material can, if desired, be removed using a suitable liquid, such as a sterile salinic solution, Locke-Ringer solution, human serum albumin, etc. Backwashing the entrapped particulate material from insert 27 constitutes a preferred method of recovering the entrapped material. Accordingly, red blood cells can, if desired, be resuspended by removing insert 27 and contacting surface 46 with suitable salinic solution or plasma, glucose-saline solution, heat inactivated human serum albumin or another transfusionable solution to bring about the release of material entrapped or enmeshed in the absorbent insert 27.

Cup 20 and cap 30 can be constructed of any suitable material, so long as the material will withstand sterilization. These portions of centrifuge device 10 are typically formed of a polymeric material, such as a polyolefin (polyethylene, polypropylene, etc.), polyvinylchloride, polyvinylidenechloride, polyvinylacetate, polystyrene, polyacrylate (e.g., polymethylacrylate), polyester, polyamide (e.g., nylon 6 or nylon 66), polycarbonate, or natural or synthetic rubbers and combinations thereof. Homopolymers as well as copolymers of the monomers can be employed. Side portion 36 of cap 30 is preferably constructed of a similar type of material in order to achieve a sealing action against wall 28 of cup 20. Alternatively, an o-ring or disk made of suitable material can be placed on surface 36 of cap 30 to provide a liquid seal with respect to surface 28 of cup 20. Suitable deformable materials of low friction include polypropylene, polyethylene, nylon, polytetrafluoroethylene and the like. These deformable materials will provide effective sealing and cause cap 30 to be retained on cup 20 during the centrifugal operation.

If desired, cup 20 can even be made from stainless steel, another suitable metal or glass which can be easily cleaned and sterilized.

Insert 27 can be any suitable material having void space which will entrap cellular components or other particulate material suspended in liquid which is introduced into centrifuge device 10. For example, an absorbent liner made of Interflo F/N 38-122-2, a hydrophilic polyethylene open cell foam having 50 to 55 micron pore size (maximum), and 50 percent void space, made by Chromex Chemical Corp., Brooklyn, N.Y., can be used. Hydrophobic polyethylene can also be used, e.g., 40–55 micron pore size hydrophobic polyethylene from the Porex Division of Glasrock Products, Inc., Fairburn, Ga. Another material is ultra high molecular weight polyethylene open cell foam having a 50 micron pore size available from General Polymeric Corp., West Reading, Pa. Other materials, such as propylene polymers, urethene polymers, porous ceramics or metals, etc., can be used provided they are inert to the liquid being fractionated. Pore size and void volume can be adapted to the particulate material present. For whole blood, for example, this pore size must be greater than about 7–8 microns.

The nature of the material used to form holder 11 is not critical and can be formed from any suitable plastic or metal material. Similarily, the nature of motor 12 is not critical. The motor speed will depend on the size of centrifuge device 10 and the amount of material introduced. The speed of angular rotation is maintained such that sufficient centrifugal force is exerted on the suspended material to bring about fractionation and separation of the suspended material from the liquid. Centrifuge device 10 must have a speed of angular rotation adequate to separate solid components from suspending liquid and cause the solid components to travel into insert 27 toward surface 46 which is closest to sidewall 28 of cup 20.

It is well known in the art that the red cell volume per unit of blood varies from individual to individual and between the sexes. This red cell volume is referred to as the hematocrit. A hematocrit can be defined as the packed red cell volume in relationship to 100 percent of the volume of blood being tested. For example, the hematocrit for women ranges between 38 percent and 42 percent. This means that for every 100 milliliters of whole blood the separate red blood cells will occupy 38 to 42 milliliters. The hematocrit for men, on the other hand, varies from about 41 percent to about 52 percent. Thus, the size of the container can be varied depending on the hematocrit of a particular unit of blood such that the container is essentially matched in volume to the sample being employed.

With a whole blood sample volume of 500 microliters it has been found that a motor speed of 7,700 revolutions per minute (rpm) for a spinning time of 60 seconds was satisfactory where the sample had a blood hematocrit value of 45 percent. 120 microliters of clear liquid was then obtained by means of pipette aspiration from the cup or enclosure means.

The temperature at which the fractionation and separation operations occur is not critical and can be at any temperature above the freezing point or coagulation point of the material introduced. In the case of whole blood, the temperature would be above the coagulation point of suspended red blood cells and below the denaturing point of red blood cells. Generally, such temperatures are in the range of 5 degrees Centrigrade to 40 degrees Centrigrade and especially desirable are temperatures in the range of 15 degrees Centrigrade to 35 degrees Centrigade. However, for prolonged repetitive use, refrigation of the centrifuge device may be required to remove mechanically produced heat and maintain suitable temperatures. Thus, suitable means could be employed to cool holder 11 or introduce coolant into the base portion of container or cup 20 beneath conical wall 24.

Thus, it will be seen that the apparatus of the present invention is well adapted to attain all of the ends and objects hereinabove set forth, together with other advantages which are inherent to the system. The apparatus has the advantages of convenience, simplicity, relatively inexpensiveness, positiveness, effectiveness, durability, accuracy and directness of action. The invention substantially overcomes problems which have existed with prior fractionation and separation devices and is essentially free of maintenance problems. Lysis of cells in whole blood does not appear to occur provided the blood is fractionated without undue delay.

As mentioned above, it will be appreciated that the present invention is not limited to the separation of cellular components such as red blood cells from whole blood, but extends to the separation of more dense solids from a mixture of suspending fluid and/or less dense solids. A solid is defined herein as any physically separable matter and includes settleable solids, suspended solids, colloidal solids, cells and formed elements of blood, e.g., platelets, granulocytes (polymorphonuclear), lymphocytes, monocytes, etc.

It will be understood that insert 27 can be formed of layers of different material and could, if desired, comprise panels, e.g., of filter paper, which are inserted into cutouts or holders positioned along side wall 28.

Instead of cap 30 container 20 could be designed with sloping walls at the top which would be effective in retaining liquid inside container 20 during the fractionation and separation operations.

Obviously, many other modifications and variations of the invention as hereinbefore set forth can be made without departing from the spirit and scope thereof.

What is claimed is:

1. Centrifuge apparatus for fractionating and separating finely divided solid particulate material suspended in a liquid comprising:

(a) enclosure means having an opening only at the top for the introduction and removal of liquid;

(b) a liner for said enclosure means for trapping inside said liner particulate material present in said liquid; and (c) means for rotating the enclosure means about the vertical axis thereof, said rotating means consisting essentially of a holder for said enclosure means which holder is rotated by a motor;

wherein the enclosure means is retained by friction fit inside said holder and wherein the holder has U-shaped cut away surfaces on two opposite sides for the insertion and removal of said enclosure means.

2. The apparatus of claim 1 which also contains a cover for said enclosure means.

3. The apparatus of claim 2 wherein the cover has an opening for the introduction and removal of liquid, said opening being surrounded by a recess for retaining liquid.

4. The apparatus of claim 1, wherein the enclosure means has a conical cavity in its base.

5. The apparatus of claim 1, wherein the liner is a polymeric material.

6. The apparatus of claim 5, in which the polymeric liner has openings in excess of 7 microns.

* * * * *